US005764267A

United States Patent [19]

Akutsu et al.

[11] Patent Number: 5,764,267

[45] Date of Patent: Jun. 9, 1998

[54] CONDUCTION RECORDING HEAD

[75] Inventors: Eiichi Akutsu; Hiroh Soga; Shigehito Ando; Susumu Hirakata, all of Kanagawa, Japan

[73] Assignee: Fuji Xerox Co., Ltd., Tokyo, Japan

[21] Appl. No.: 649,474

[22] Filed: May 17, 1996

Related U.S. Application Data

[63] Continuation of Ser. No. 61,383, May 14, 1993, abandoned.

[30] Foreign Application Priority Data

May 15, 1992 [JP] Japan ..... 4-147984

[51] Int. Cl.[6] ..... B41J 2/395

[52] U.S. Cl. ..... 347/199; 29/611

[58] Field of Search ..... 347/209, 199, 347/200; 29/611

[56] References Cited

U.S. PATENT DOCUMENTS

| | | | |
|---|---|---|---|
| 4,684,960 | 8/1987 | Nishiwaki | 346/76 PH |
| 4,835,552 | 5/1989 | Akutsu et al. | 346/76 PH |
| 4,980,705 | 12/1990 | Akutsu et al. | 347/199 |
| 4,990,935 | 2/1991 | Takemoto et al. | 347/200 |
| 5,200,760 | 4/1993 | Ujihara et al. | 347/201 |
| 5,278,580 | 1/1994 | Nishikawa et al. | 347/200 |

FOREIGN PATENT DOCUMENTS

| | | | |
|---|---|---|---|
| 0035357 | 2/1988 | Japan | 346/76 PH |
| 0047151 | 2/1988 | Japan | 346/76 PH |
| 0047152 | 2/1988 | Japan | 346/76 PH |
| 0047153 | 2/1988 | Japan | 346/76 PH |
| 0214458 | 9/1989 | Japan | 346/76 PH |

OTHER PUBLICATIONS

Sawai et al., "The Development of the Conduction Transcribing Recording Head," The Preliminary Magazine of the 102nd Meeting of the Image Electricity Conference, Jan. 29, 1988.

USUT et al., "The Conduction Thermal Transcribing Recording Head Type Color Video Printer I," The Preliminary Magazine of the 93rd Meeting of the Image Electricity Conference, Sep. 9, 1986.

Fukui et al., "The Technology of High and Multi Rotary Dye Rotation," The Electrical Photography Conference JHC, Jun. 22, 1990.

Nakano et al., "The Research of Conduction Transcribing Recording Materials," The Image Electricity Conference of the 11th Role, No. 1, 1982.

*Primary Examiner*—Huan H. Tran

*Attorney, Agent, or Firm*—Finnegan, Henderson, Farabow, Garrett & Dunner, L.L.P.

[57] ABSTRACT

A conduction recording head forms an image on a recording sheet by connecting return path electrodes and recording electrodes conductively through a printing and recording medium. Recording electrodes, a drive circuit and connector electrodes are all disposed integrally on a flexible insulating film as a main head part which is disposed on a rigid support member through an elastic member.

2 Claims, 2 Drawing Sheets

CONDUCTION RECORDING HEAD

This application is a continuation of application Ser. No. 08/061,383 filed May 14, 1993, now abandoned.

BACKGROUND OF THE INVENTION

The present invention relates to a conducting recording head for use in a conduction recording method.

An image is formed according to a conduction recording method in the following manner. That is, there is used a printing and recording medium including a heating layer adapted to generate heat due to current conduction and a thermally fusible ink layer adapted to be fused to the heat generating layer. A conduction recording head comprising a plurality of independent recording electrodes arranged in parallel is brought into contact with the heating layer side of the printing and recording medium.

The heating layer is then electrically energized in correspondence to image information from the recording electrodes of the recording head to thereby heat the electrically energized portions of the heating layer. The portions of the thermally fusible ink layer that correspond to the energized and heated portions of the heating layer are fused and transferred to a recording sheet, whereby the image is formed. In this method, electrodes for return paths are also made to contact with the printing and recording medium simultaneously with the recording electrodes.

A conduction recording head, usable in the above-mentioned conduction recording method, generally comprises recording electrodes arranged in parallel on a rigid support member. A drive circuit is used to apply an electric signal corresponding to image information to the recording electrodes. Connector electrodes are used, to connect image information signals and the like to the drive circuit from an image forming device which is disposed on a substrate provided separately from the rigid support member. The recording electrodes, drive circuit and connector electrodes are electrically connected to one another.

However, the above-mentioned conventional conduction recording head has no flexibility due to the fact that the recording electrodes are disposed on a rigid support member formed of ceramic material of the contact surface of the printing and recording medium lacks uniformity that is, if it is undulated, then the recording electrodes are not contact uniformly, thereby causing some printing dots to be omitted, which results in a defective image.

In order to prevent poor contact of the recording electrodes, the present applicant has previously proposed a recording head in which recording electrodes are disposed on a rigid support member through an elastic layer (Japanese Patent Unexamined Publication No. Sho. 63-47151).

However, while the poor contact of the recording electrodes can be improved due to the elastic action of the elastic layer when compared with the conventional recording head, the contact stability of the recording electrodes in the width direction of the recording head is insufficient. This makes it difficult to elongate (widen) the recording head. That is, the more the recording head is elongated, the more difficult the contact stability of the recording head is in the width direction, which is apt to produce a defective image.

Also, in any of conventional conduction recording heads, recording electrodes and a drive circuit for driving the recording electrodes are provided on separate support members (substrates). Therefore, their connection portions are large in number and are quite complicated in structure, so that the whole recording head is complicated in structure and is troublesome in production. That is, it is difficult to mass-produce such recording heads. Further, the above-mentioned structure further makes it difficult to elongate the recording head, or the connection portions of the structure can be broken or shorted due to vibration or the like. In addition, the whole size of the recording head becomes relatively large.

SUMMARY OF THE INVENTION

The present invention aims at eliminating the above-mentioned drawbacks found in the conventional recording heads. Accordingly, it is an object of the invention to provide a new conduction recording head which can provide uniform printing with high resolution in the head width direction, can be easily elongated to thereby allow mass production, and is compact and simple in structure.

In attaining the above object, according to the invention, there is provided a conductive recording head which forms an image by contacting return-path electrodes and recording electrodes with a printing and recording medium, wherein the recording electrodes a, drive circuit and connector electrodes are disposed integrally on a flexible insulating film to thereby form a head main part, and the head main part is put on a rigid support member through an elastic member.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate a preferred embodiment of the invention and together with the description provide an explanation of the objects, advantages and principles of the invention. In the drawings:

FIG. 1(*b*) is a section view taken along the reference line b—b in FIG. 1(*a*)

DESCRIPTION OF THE INVENTION

Figure 1A:
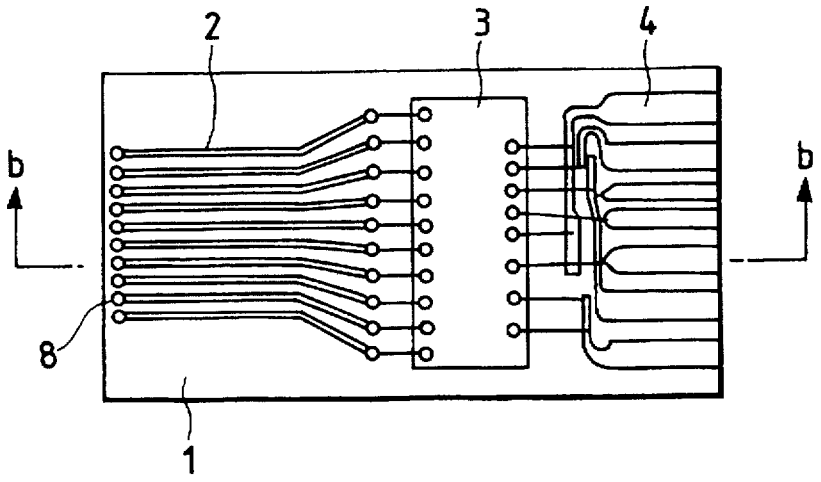
FIG. 1(*a*) is a plan view of an embodiment of a conduction recording head according to the present invention.
Figure 1B:
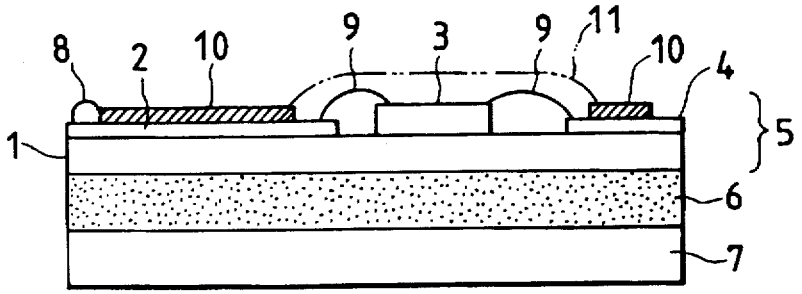
Figure 2A:
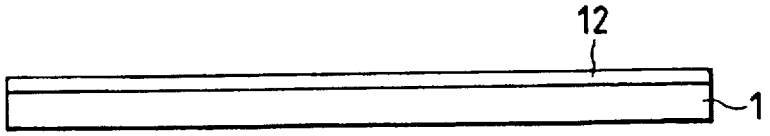
FIGS. 2*a*–2*f* is a manufacturing flow diagram illustrating a process for manufacturing a conduction recording head according to the invention.
Figure 2B:
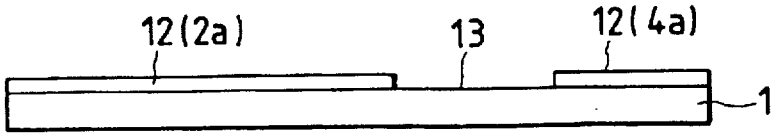
Figure 2C:
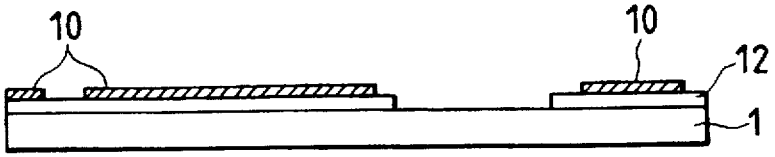
Figure 2D:
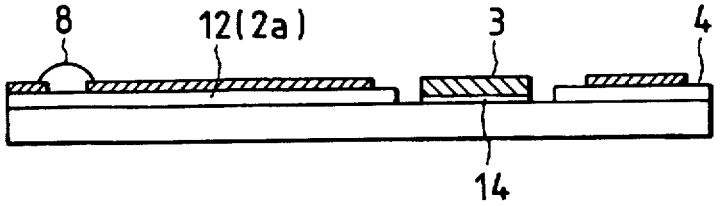
Figure 2E:
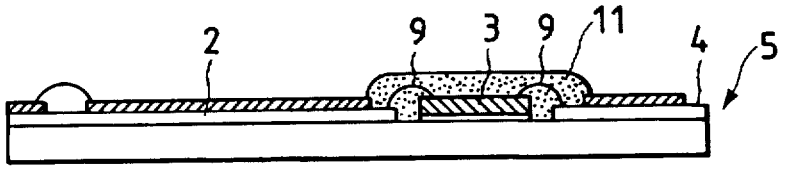
Figure 2F:
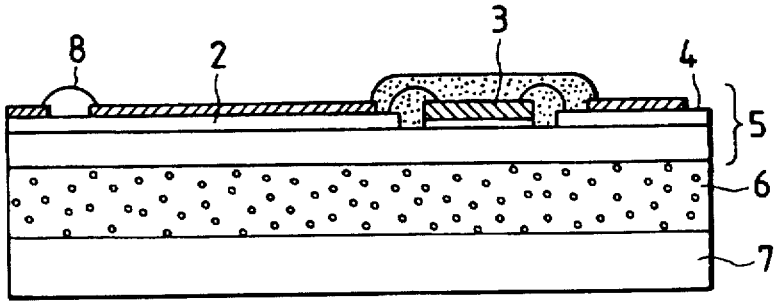

A conduction recording head according to the invention, as shown in FIGS. 1*a* and 1*b*, is constructed in such a manner that recording electrodes 2, a drive circuit 3 and connector electrodes 4 are disposed integrally on a flexible insulating film 1 thereby to form a main head part 5. The main head part 5 is disposed on an elastic member 6 which, in turn, is disposed on a rigid support member 7.

A bump portion is formed in the leading end portion of each of the recording electrodes 2. The reference character 9 designates a connection, and an insulating protection layer 10, and a coating film 11 are included in the main head part 5.

The main head part 5 having the above-mentioned structure can be constructed, for example, in the following manner.

As shown in FIG. 2(*a*), a thin metal film 12 is first formed on the flexible insulating film 1(*a*), and then the metal thin film 12 is etched according to a photolithographic method or the like thereby to form wiring patterns 2*a*, 4*a* for the recording electrodes and connector electrodes 2(*b*).

In FIG. 2(*b*), a pad portion 13 packages an IC chip or the like which forms the drive circuit 3. Next, the insulating protect layers 10 are provided only in given portions FIG. 2(*c*) and then the leading end portion of the recording electrode wiring pattern 2*a*, pad portion 13 and the like are coated with a preselected metal such as nickel or the like according to a plating method or the like thereby to form the bump portion 8 and wire bonding portion 14.

An IC chip or the like for the drive circuit is then die bonded onto the wire bonding portion 14 of the pad portion 13, FIG. 2(*d*). The recording electrodes 2 are connected to the drive circuit 3 and the drive circuit 3 is connected to the connector electrodes 4, respectively by means of connections 9. The coating film 11 is formed in such a manner that it covers the upper portion of the drive circuit 3 and peripheral portion thereof, whereby the main head part 5 is produced as shown in FIG. 2(*e*).

However, the main head part 5 may be produced by methods other than the above-mentioned method.

A synthetic resin film which is formed of polyimide, polyethylene phthalate, polyamide, polysulfone or the like can be used as the flexible insulating film 1.

Preferably, a heat resistant film having a thickness of 10 to 150 μm may be used, for the film 1 and more preferably, a heat resistant film having a thickness of 10 to 40 μm may be used. If the thickness of the film 1 is smaller than 10 μm, it is difficult to treat the film 1 when the recording head is produced and it is also difficult to package the IC chip or the like into the recording head. On the other hand, if the thickness of the film 1 is greater than 150 μm, an elastic action by the elastic members 6 cannot be obtained with high efficiency, thereby interfering with uniform and stable pressure contact of the recording head (in particular, recording electrodes). It is also preferable that the film 1 be heat resistant at a temperature of 150° C. or higher, and preferably, at a temperature of 200° C. or higher.

Each of the recording electrodes 2 is processed according to a photolithographic method or the like so as to have a given width and a given pitch, so that it has, for example, a striped pattern. The printing width of the recording head is determined by the number of recording electrodes used in the head.

The bump portion 8 in the recording electrode 2 is a projection which, when the recording head is pressed against the printing and recording medium, allows the recording electrodes to contact with the surface of the recording medium efficiently and positively. Preferably, the bump portion 8 is formed in a projecting shape with the height of the top surface of the bump portion 8 from the surface of the film 1 in a range of 11 μm to 50 μm. If the height of the top surface of the bump portion 8 is less than 11 μm, the above-mentioned function of the bump portion 8 cannot be performed. If the height exceeds 50 μm, it is difficult to obtain a uniform pressure contact among the bump portions, and the production of the bump portions 8 is difficult.

Each of the recording electrodes 2 is formed mainly of a metal such as copper, nickel, molybdenum, tungsten, rhodium or the like. In some cases, the recording electrode 2 may be treated by composite plating in which ceramic powder, carbon power, bone powder and the like are dispersed.

The drive circuit 3 is formed integrally with the flexible insulating film 1 by packaging an IC pulse-signal-drive chip or the like onto the film 1. A method for connecting the drive circuit with the recording electrodes and contact electrodes may be the above-mentioned wire bonding method by means of the connection, but other methods such as a flip chip packaging connecting method, an anisotropic conduction film connecting method or other similar methods may be employed.

However, the wire bonding method is best from the standpoint of current withstand property and connection reliability and, according to the wire bonding method, if the metal material of the bonding mound serving as the connector electrode is a hard metal material, then the wire bonding is possible even if the electrode thickness is smaller than 50 μm, and thus the packaging connection reliability is easily obtained. To improve the packaging connection reliability further, a hard plate may be placed under the bonding mound of the flexible insulating film.

According to the recording head of the invention, the above-mentioned main head part 5 thereof, as shown in FIG. 2(*f*), is placed through the elastic member 6 on the rigid support member 7.

Rubber, such as silicone rubber, urethane rubber or the like, a porous substance, a foaming substance or the like can be used for the elastic member 6. A rubber hardness of a range of 20 to 60, may be provided for the elastic member 6, but a range of 30 to 50 is preferred. If the rubber hardness is less than 20, the contact pressure of the recording head cannot be given sufficiently and it is difficult for the elastic member 6 to make an elastic contact with the printing and recording medium. On the other hand, if the rubber hardness exceeds 60, a proper elastic action cannot be obtained so that poor contact of the recording electrode can easily occur.

The thickness of the elastic material 6 may be in a range of 0.5 to 60 mm, and, preferably, in a range of 3 to 20 mm. If the thickness is less than 0.5 mm, it is difficult to provide sufficient elasticity as an elastic material. On the other hand, if the thickness exceeds 60 mm, the size of the whole recording head becomes large and the leading end portion of the recording head is apt to be unstable.

The rigid support member 7 can be appropriately selected from various rigid materials, provided that is has such rigidity as to allow the recording head to be pressed against the printing and recording medium with a desired pressure. For example, a glass-epoxy material, a metal plate formed of metal such as aluminum, or the like can be used for support member.

To assemble the main head part 5 with the elastic member 6 and the rigid support member 7, a bonding method may be employed which uses adhesives such as silicone-system adhesives, epoxy-system adhesives or the like. This layer-piling can also be accomplished by appropriate methods other than the above-mentioned bonding method. For example, a method can be used in which the layers are piled one on another and are then mechanically pressed and connected from both sides thereof.

The printing and recording medium to be used, when recording is executed by use of the recording head of the invention, must include, at least, a conductive heating layer adapted to generate heat due to image representing current conduction from the recording electrodes 2 that are pressure contacted by the recording head. A thermally fusible ink layer is required for fusing by the heat generated by the conductive heating layer.

The electrodes for return paths, which are made to contact with the printing and recording medium in the recording, may be provided integrally with or separately from the recording head.

Further, a back surface pressure contact member (such as a pressure contact roll or the like), which is disposed on the back surface of a recording sheet when the recording head of the invention is brought into pressure contact with the printing and recording medium, must be a rigid member which has excellent surface smoothness.

The conduction recording head of the invention is used in a conduction or electric energization recording method. In the recording, the conduction recording head is pressure contacted with a recording medium in such a manner that a plurality of recording electrodes (bump portions) disposed in the edge portion of the recording head are slidable along the surface of the recording medium. The image information signals that are input from the contact electrodes are distributed and applied by the drive circuit to predetermined recording electrodes in the form of electric signals. The portions of the heating layer that correspond to the recording electrodes to which the electric signal have been applied are caused to generate heat, and the thermally fusible ink layer corresponding to the heated portion of the heating layer is fused and is then transferred to the recording sheet, whereby the image can be recorded.

In this operation, according to the recording head of the invention, because the undulations of the printing and recording medium as well as the undulations and flexings of the back surface roll and the like are absorbed by the elastic deformation of the elastic member, the recording electrodes can always contact the printing and recording medium uniformly and stably over the whole area.

More detailed description of the preferred embodiments of the invention is set forth hereinafter.

EMBODIMENT 1

As shown in FIG. 2(*a*), a copper foil 12 having a thickness of 12 μm was put and bonded onto a polyimide film 1 having a thickness of 25 μm by means of silicone system adhesives. Next, after a resist was coated onto the copper foil 12, the resist was exposed to a pattern light and was thereby developed, the resist film was patterned, and the copper foil was etched, whereby a wiring pattern serving as a basic wiring pattern was formed on the polyimide film (FIG. 2(*b*)).

Next, nickel was plated on the whole surface of the wiring pattern to form a corrosion resisting film having a thickness of 1.5 μm. Then, photosensitive amic acid was applied onto the corrosion resisting film of the wiring pattern to remove the portions of the corrosion resisting film located in the leading end portion of the recording electrode wiring pattern, the wire bonding pad portion of the drive circuit and the connector electrodes according to a photolithographic method. The remaining portions of the coated, corrosion resisting film were then heated and hardened thereby to produce an insulating protect layer 10 having a thickness of 5 μm (FIG. 2(*c*)).

A phosphorous-nickel material having a thickness of 25 μm was then plated onto the leading end portion of the recording electrode wiring pattern according to a nickel plating method thereby to produce a bump portion 8. Gold was next plated onto the wire bonding pad portion 13 and contact electrode portion 4 to form a coated gold film having a thickness of 8 μm. Thereafter, a pulse signal driving IC (a driver IC for a thermal head) 2 was die bonded onto the wire bonding pad portion 13 on the film 1 (FIG. 2(*d*)).

Next, a gold wire of 25 μmϕ was used to provide a connection 9 between the bonding pad on the IC chip and the bonding pads on the recording and connector electrode wiring patterns. The upper surface of the IC chip and its peripheral area were coated with silicone resin thereby forming a coating film 11. Finally the polyimide film, which had been subjected to these various processing steps, was cut to a predetermined size according to a head unit, thereby producing the main head part 5 (FIG. 2(*e*)).

The main head part 5 was bonded onto a silicone rubber support member 6 having a rubber hardness of 40 and a thickness of 4 mm. The back surface side of the rubber support member 6 was next bonded onto an aluminum base member 7 having a thickness of 30 mm, thereby producing a conduction recording head having a printing width of 50 mm and a resolution of 12 dots/mm (FIG. 2(*f*)). The bump portion 8 in the recording electrodes of the present recording head provided a projection shape having a plane size of 60 μm×45 μm and having a height from the surface of the film 1 of 18 μm.

The resulting recording head was pressed against an ink ribbon for conductive transfer with a line pressure of 300 g/cm. Printing recording was executed under the image (dot) signal conditions that an applied voltage was 8V and a pulse width was 600 μ sec., and the sizes and shapes of the printing dots in several printing positions in the head width direction shown in Table 1 were measured and observed. The measurement and observation results are shown in Table 1. Also, in this measurement and observation, a printing ratio with respect to the image input signal was 100% and no omitted printing occurred at all in the head width direction.

TABLE 1

| | | Printing position (distance from left end) | | | |
|---|---|---|---|---|---|
| | | 5 mm | 20 mm | 30 mm | 45 mm |
| Embodiment 1 | Size (mm) | 96 × 110 | 04 × 92 | 01 × 90 | 93 × 105 |
| | Dot shape | round dish rectangle | same as left | same as left | same as left |
| Comparative 1 | Size (mm) | 132 × 140 | 115 × 120 | 60 × 52 | unprinted |
| | Dot shape | circular shape | circular shape | stellate shape | — |
| Comparative 2 | Size (mm) | unprinted | 30 × 70 | 95 × 101 | 142 × 110 |
| | Dot shape | — | stellate shape | elliptic shape | elliptic shape |

COMPARISON 1

Except for use of an alumina substrate having a thickness of 1.0 mm instead of the polyimide film 1 having a thickness of 25 μm, a conduction recording head was produced similarly to the Embodiment 1 and, thereafter, printing recording was executed similarly to the embodiment 1. The results of measurements and observations in the comparison 1 are also shown in Table 1. As can be observed clearly from Table 1, in the case of the recording head according to the comparison 1, the sizes and shapes of the printing dots varied greatly in the head width direction and occurrence of omitted printing was observed.

COMPARISON 2

In this case, the silicone rubber support member 6 was not used and the main head part 5 was bonded directly onto the aluminum base member 7. A conduction recording head was produced similarly to the Embodiment 1 and, thereafter, printing recording was executed similarly to the Embodiment 1. The measurement and observation results thereof are also shown in Table 1.

COMPARISON 3

The plating thickness (25 μm) of the bump portion 8 of the recording electrode in the Embodiment 1 was changed to a thickness of 15 μm. A conduction recording head was produced similarly to the Embodiment 1. The resultant recording electrode bump portion 8 had an average height from the film surface of 3 μm. After an endurance test corresponding to 2 Km was conducted on the recording head, printing recording was executed similarly to the Embodiment 1. The results showed that the printing condition was poor, a printing ratio had a low value of 68%, and poor printing was found.

EMBODIMENT 2

A precursor of polyimide having a thickness of 20 μm was coated onto a copper foil having a thickness of 20 μm and was then dried. Thereafter, a photo-resist was coated onto the surface of the copper foil and was then heated and dried, and a wiring pattern was exposed, developed and etched thereby producing a wiring pattern in the recording electrode portion with a width of 45 μm and a pitch of 64 μm.

Next, a hole portion of 40 μm □ was formed by 5 photoresist means so as to extend from a portion 20 μm inside the leading end of the recording electrode wiring pattern to the polyimide precursor layer. Thereafter, plating was grown in the hole portion according to a nickel plating step to provide nickel plating having a thickness of 25 μm, thereby producing the recording electrode bump portion.

Then, the polyimide precursor was heated at a temperature of 380° C. for thirty minutes to be turned into imide, thereby producing a polyimide film layer having a thickness of 12 μm. Simultaneously with this step, the nickel plated film was processed to become a hard film.

Further, a driving IC chip was die bonded onto an IC packaging pad formed in the nickel plating step simultaneously with the nickel plating by increasing the thickness of the pad. Thereafter, with use of a gold wire of 20 μmϕ, the IC chip was wire bonded to the connector electrode portion. Next the upper surface of the IC chip and its peripheral area were coated with silicone resin thereby to complete a flexible print circuit (FPC).

The FPC was bonded and piled sequentially onto the silicone rubber member and aluminum support member which were similar to those in the Embodiment 1, thereby producing a conduction recording head having a printing width of 200 mm, 400 DPI. The recording electrode bump portion of the present recording head had a plane size of 30 μm×28 μm and had a projecting shape the height of which from the surface of the film 1 was 8 μm.

By use of the present recording head, printing recording was executed similarly to the Embodiment 1 except that, as the image signal conditions thereof, an applied voltage was 15V and a pulse width was 800 μ sec. The results of the printing recording are shown in Table 2. Also, a printing ratio with respect to image input signals was 98.2% and almost all of the printing dots were printed substantially uniformly.

TABLE 2

| | | Printing position (distance from left end) | | | |
|---|---|---|---|---|---|
| | | 20 mm | 100 mm | 110 mm | 190 mm |
| Embodiment 2 | Size (mm) Dot shape | 75 × 90 round dish rectangel | 66 × 70 circular shape | 72 × 80 circular shape | 82 × 97 round dish rectangle |

EMBODIMENT 3

After a polyimide precursor having a thickness of 15 μm was coated onto a copper foil of 13 μm and was then dried, a photo-resist was coated onto the surface of the copper foil and was then heated and dried, and a wiring pattern was exposed, developed and etched thereby to produce a wiring pattern in the recording electrode portion with a width of 45 μm and a pitch 64 μm.

Next, after a hole portion of 23 μm □ was formed by photo-resist means so as to extend from a portion 20 μm inside the leading end of the recording electrode wiring pattern to the polyimide precursor layer, according to a nickel plating step, plating was grown in the hole portion to provide a nickel plating having a thickness of 12 μm. Next rhodium, with a thickness of 3 μm, was plated onto the nickel plated layer thereby producing a recording electrode bump portion.

The polyimide precursor was then heated at a temperature of 380° C. for 30 minutes to be converted into imide, thereby producing a polyimide film layer having a thickness of 7 μm.

Therefore, a driving IC chip was die bonded onto an IC packaging pad simultaneously with the nickel plating by increasing the thickness of the nickel plating by 5 μm in the nickel plating step. The IC chip was wire bonded to the connector electrode portion by use of a gold wire of 20 μmϕ. Next the upper surface of the IC chip and its peripheral area were coated with silicone resin, thereby completing an FPC. The FPC was sequentially bonded and piled on the same silicone rubber member and aluminum support member as those in the Embodiment 1, thereby producing a conduction recording head having a printing width of 50 mm, 400 DPI. The recording electrode bump portion of the recording head thus produced had a projecting shape which had a plane size of 36 μm×39 μm □ and a height from the surface of the film 1 of 12 μm.

By use of the present recording head, printing recording was executed similarly to the Embodiment 1 except that an applied voltage was 12V and a pulse width was 1.2 milliseconds as the image signal conditions thereof. In this case, a printing ratio with respect to image input signals was 99.2%. Also, after an endurance test corresponding to 1 Km was conducted on the recording head, printing recording was executed similarly to the Embodiment 1. In the latter case, a printing ratio with respect to image input signals was 97.2% and almost all of the print dots were printed substantially uniformly.

EMBODIMENT 4

A cooper foil having a thickness of 15 μm was bonded and piled on a polyimide film 1 having a thickness of 30 μm with silicone-system adhesives. Then, after a resist was coated onto the copper foil, it was pattern exposed and developed. The resist film was patterned, and the copper foil was etched, and a wiring pattern serving as a basic pattern was produced on the polyimide film 1.

Next, after nickel was plated 1.5 μm in thickness on the whole surface of the wiring pattern to form a corrosion resisting film, light-sensitive amic acid was coated on the corrosion resisting film. The portions of the coated film located in the leading end portion of the recording electrode wiring pattern, the wire bonding pad portion of the drive circuit and the connector electrode portion were removed—according to a photolithography method. Thereafter, the remaining portions of the coated film were heated and hardened thereby to form an insulating protect layer having a thickness of 5 μm.

A SiC fine grain dispersed nickel material of 25 μm in thickness was then plated on the leading end portion of the recording electrode wiring pattern according to a SiC fine grain dispersed nickel combining method. Gold plating of 8 μm in thickness was applied onto the wire bonding pad portion and contact electrode portion. A signal pulse driving IC (a driver IC for thermal head) was then die bonded onto the wire bonding pad portion of the film, and the back surface portion of the film just under the wire bonding pad portion was next partly backed with a SUS plate having a thickness of 100 μm.

By use of a gold wire of 25 μmϕ, the bonding pad on the IC chip was next connected with the bonding pads on the recording electrode and connector electrode pads. The upper surface of the IC chip and its peripheral area were then coated with silicone resin to form a coated film, and finally the polyimide film, which had been subjected to these various processing steps, was cut to a given size according to a head unit, thereby producing a main head part.

The main head part, thus produced, was bonded onto a silicone rubber support member having a rubber hardness of 30 and a thickness of 4 mm. The back surface side of the rubber support member was then bonded onto an aluminum base member having a thickness of 30 mm, thereby producing a conduction recording head having a print width of 40 mm and a resolution of 12 dots/mm. The conduction recording head thus produced included a bump portion in the recording electrodes thereof and the bump portion was formed in a projecting shape having a plane size of 56 μm×46 μm and a height from the film surface of 10 μm.

The recording head produced in the above-mentioned manner was pressed against an ink ribbon for conductive transfer with a line pressure of 300 g/cm and printing recording was executed under the image (dot) signal conditions that an applied voltage was 8V and a pulse width was 1.0 milliseconds. According to the results of the printing recording, a printing ratio with respect to the image input signals was 100% and no omitted printing occurred in the head width direction. After an endurance test corresponding to 4 Km was conducted on the recording head, printing recording was executed similarly to the Embodiment 1. According to the results of the printing recording, a good printed condition was observed and the printing ratio was a high value of 98%.

COMPARISON 4

When the sequence of the operation steps in the Embodiment 1 was changed and the wire bonding step was performed after the step of bonding the elastic member, the connection reliability of the wire bonding was lowered and the printable dot ratio was 42%. A projection observation by use of X-rays showed that the lowered connection reliability and low printable dot ratio were caused mainly by the poor connection between the bonding mound and wire of the wire bonding.

EMBODIMENT 5

After a polyimide precursor was coated 15 μm in thickness onto a copper foil of 20 μm and was then dried, a photo-resist was coated onto the surface of the copper foil and was then heated and dried. A wiring pattern was exposed and developed, and etched, thereby producing a wiring pattern in the recording electrode portion with a width of 85 μm and a pitch of 125 μm.

Next, after a hole portion of 53 μm □ was formed by photo resist means so as to extend from a portion 40 μm inside the leading end of the recording electrode wiring pattern to the polyimide precursor layer, nickel plating was grown in the hole portion to provide a nickel plated layer having a thickness of 12 μm. Next, tungsten was plated 18 μm in thickness on the nickel plated layer, thereby producing a recording electrode bump portion.

The polyimide precursor was then heated at a temperature of 380° C. for 30 minutes to be converted into imide, thereby producing a polyimide film layer having a thickness of 7 μm.

After a pulse driving IC chip was die bonded onto an IC packaging pad, the IC chip, the connector electrode portion, and the bonding mound, with the thickness thereof increased according to the nickel plating and tungsten plating steps, were connected to one another by use of a gold wire of 30 μmϕ. The upper surface of the IC chip and irs peripheral area were then coated and potted with silicone resin, thereby completing an FPC.

The FPC was bonded and piled on the same silicone rubber member and aluminum support member as in the Embodiment 1 in the same order, whereby a conduction recording head was produced with a printing width of 50 mm, 200 DPI. The recording electrode bump portion of the recording head had a projecting shape which had a plane size of 86 μm×79 μm □ and a height from the surface of the film 1 of 18 μm.

By use of the recording head, except for use of image signal conditions of an applied voltage of 10V and a pulse width of 1.5 milliseconds, printing recording was executed similarly to the Embodiment 1. The results of the printing recording showed that a printing ratio with respect to the image input signals was 99.2%. After an endurance test corresponding to 4 km was conducted on the recording head, similar printing recording to the embodiment 1 was executed. In the latter case, a printing ratio of 97.6% was provided with respect to the image input signals and almost all of the printing dots were printed substantially uniformly.

EFFECTS OF THE INVENTION

As has been described heretofore, according to the invention, due to the fact that the recording electrodes, drive circuit and connector electrodes are disposed integrally on the same film base member, there is provided a conduction recording head that is compact and simple in structure.

Since the integrally formed main head part is piled on the rigid support member through an elastic member, there is provided an excellent contact stability of the recording electrodes with respect to the surface of the printing and recording medium, which prevents any printing dot from being omitted and also allows printing to be achieved uniformly and with high resolution over the whole area in the head width direction.

Further, the structure of the main head part formed integrally in the above-mentioned manner makes it easy to elongate the main head part, prevents occurrence of breakage and short-circuits due to vibrations or the like, and permits facilitated mass production. Thus, a recording head is provided which has a wide printing width, an excellent printing characteristic, and excellent endurance yet which is inexpensive to manufacture.

The foregoing description of the preferred embodiment has been presented to illustrate the invention. It is not intended to be exhaustive or to limit the invention to the form disclosed. In applying the invention, modifications and variations can be made by those skilled in the pertaining art without departing from the scope and spirit of the invention. It is intended that the scope of the invention be defined by the claims appended hereto, and their equivalents.

What is claimed is:

1. A method of producing a conduction recording head comprising the steps of:

preparing a flexible wiring member by performing the steps of:

disposing recording electrodes, connector electrodes and drive circuitry on a flexible insulating film;

electrically connecting said recording electrodes and connector electrodes with said drive circuitry by wire bonding while the flexible insulating film is backed by a hard plate; and applying an insulating coating to cover said drive circuitry and to embed said wire bonding;

preparing a support for the conduction recording head by disposing an elastic member on a rigid support member; and disposing said flexible wiring member on said elastic member subsequent to said preparing steps.

2. The method of claim 1, wherein the step of disposing recording electrodes, connector electrodes, and drive circuitry on a flexible insulating film and the step of disposing said flexible wiring member on said elastic member subsequent to said preparing steps are performed using adhesives.

* * * * *